US011439247B2

(12) United States Patent
Schell

(10) Patent No.: US 11,439,247 B2
(45) Date of Patent: Sep. 13, 2022

(54) BED FRAME FOR SIDE SLEEPING

(71) Applicant: Mary Ann Schell, Largo, FL (US)

(72) Inventor: Mary Ann Schell, Largo, FL (US)

( * ) Notice: Subject to any disclaimer, the term of this patent is extended or adjusted under 35 U.S.C. 154(b) by 96 days.

(21) Appl. No.: 16/895,329

(22) Filed: Jun. 8, 2020

(65) Prior Publication Data

US 2020/0297124 A1 Sep. 24, 2020

Related U.S. Application Data

(63) Continuation-in-part of application No. 15/927,485, filed on Mar. 21, 2018, now abandoned.

(60) Provisional application No. 62/484,440, filed on Apr. 12, 2017.

(51) Int. Cl.
*A47C 19/02* (2006.01)

(52) U.S. Cl.
CPC ..... *A47C 19/025* (2013.01)

(58) Field of Classification Search
CPC ..... A47C 19/025; A47C 20/08; A47C 20/041; A47C 17/17; A47C 17/04; A47C 17/16; A47C 17/161; A47C 17/162; A47C 17/175; A47C 17/1756; A47C 17/70; A47C 19/124; A47C 19/12; A61G 7/001; A61G 13/0009; A61G 2203/12; A61G 7/008; A61G 7/015; A61G 7/018
USPC ..... 5/131
See application file for complete search history.

(56) References Cited

U.S. PATENT DOCUMENTS 888,865 A * 5/1908 Bennett ..... A47C 17/1756 5/47
905,702 A * 12/1908 Hunter ..... A47C 17/16 5/52
907,068 A * 12/1908 Luppino ..... A47C 17/1756 5/47
1,876,743 A * 9/1932 Pilates ..... A47C 17/1753 5/47
2,089,867 A * 8/1937 Welch ..... A47C 17/162 297/357
2,113,286 A * 4/1938 White ..... A47C 20/043 5/942
2,208,945 A * 7/1940 Miller ..... A47C 17/162 297/170
2,562,339 A * 7/1951 Socol ..... A47C 3/02 482/142

(Continued)

FOREIGN PATENT DOCUMENTS

WO 2008003027 1/2008
WO 2015108653 7/2015

*Primary Examiner* — Peter M. Cuomo
*Assistant Examiner* — Luke Hall
(74) *Attorney, Agent, or Firm* — Larson & Larson, P.A.; Justin P. Miller; Frank Liebenow

(57) ABSTRACT

The invention is an asymmetrical bedframe. The bedframe is divided off-center, forming a first platform, or back support section and a second platform, or leg support section. Preferably, the platforms are split to separate the area of the bed frame into a first platform that occupies one-third of the area of the bedframe, and a second platform that occupies two-thirds of the area of the bedframe. The first platform—the smaller area—is intended to support the back of the user or sleeper, specifically by providing a rotational force to keep the user on their side. The second platform—the larger area—is intended to support the body of the user, including head, arms, torso, legs, and feet.

16 Claims, 9 Drawing Sheets

(56) References Cited

U.S. PATENT DOCUMENTS 2,656,877 A * 10/1953 Woller ..... A47C 17/161 297/114
2,662,585 A * 12/1953 Ozenne ..... A47C 17/162 297/375
2,769,987 A * 11/1956 Thal ..... A47C 17/162 5/927
3,132,897 A * 5/1964 Linden ..... A47C 17/162 297/340
3,564,625 A 2/1971 Danielson
4,104,747 A * 8/1978 Bell ..... A47C 17/1756 5/47
4,225,988 A 10/1980 Cary et al.
4,608,722 A * 9/1986 Zorzetto ..... A47C 17/161 5/13
4,941,221 A 7/1990 Kanzler
5,224,228 A * 7/1993 Larrimore ..... A61G 7/008 5/942
5,315,722 A * 5/1994 Djie ..... A47C 17/175 5/38
5,345,626 A * 9/1994 Newton ..... A47C 17/1756 5/41
7,246,389 B2 7/2007 Taguchi et al.
7,886,379 B2 2/2011 Benzo et al.
8,056,163 B2 11/2011 Lemire et al.
8,713,726 B1 * 5/2014 Erdman ..... A47C 17/1756 5/47
2005/0160530 A1 * 7/2005 Taguchi ..... A61G 7/015 5/613
2006/0101581 A1 * 5/2006 Blanchard ..... A61G 7/05784 5/713
2008/0185889 A1 * 8/2008 Kipperman ..... A47C 13/00 297/284.3
2011/0016626 A1 * 1/2011 Kanthasamy ..... A47C 17/16 5/37.1
2014/0033427 A1 * 2/2014 Yang ..... A47C 17/16 5/38
2017/0046620 A1 * 2/2017 Morrison ..... A61G 7/05761
2017/0100277 A1 * 4/2017 Ke ..... A61F 5/56
2019/0029434 A1 * 1/2019 Platzer ..... A47C 17/162

* cited by examiner

BED FRAME FOR SIDE SLEEPING

CROSS-REFERENCE TO RELATED APPLICATION

This application is a continuation-in-part of U.S. patent application Ser. No. 15/927,485, filed Mar. 21, 2018, titled Cradling Bed Assembly and Related Method, which was in turn a continuation of U.S. Pat. App. Ser. No. 62/484,440, filed Apr. 12, 2017, titled Adjustable Bed and Method of Use.

FIELD

This invention relates to the field of bed frames and more particularly to a bed frame for use by side-sleepers.

BACKGROUND

Many medical conditions are improved by sleeping on one's side. For example, sleep apnea, snoring, acid reflux, poor digestion, and abdominal pressure from retained water or obesity.

Pregnant women are specifically advised to sleep on their sides to decrease the pressure resulting from the weight of the baby, placenta, and other abdominal weight.

While the benefits of side sleeping are significant, maintaining a side sleeping position is difficult. Commonly, as soon as the sleeper falls asleep, they roll onto their back, thus preventing benefits from side sleeping.

Impractical devices exist to attempt to keep the user in a side-sleeping position. For example, wedge pillows, long C-shaped body pillows, and pillows with holes to trap a sleeper's arm and shoulder. But none of the devices is effective because each fails to provide a force against sleeper's back to prevent rotation.

What is needed is a bed frame that supports a user during sleep, helping the user to maintain the ideal position for side sleeping.

SUMMARY

The invention is an asymmetrical bedframe. The bedframe is divided off-center, forming a first platform, or back support section, and a second platform, or leg support section.

The platforms are preferably split to separate the area of the bed frame into a first platform that occupies one-third of the area of the bedframe, and a second platform that occupies two-thirds of the area of the bedframe. Stated differently, the first platform has one-half or less of the surface area, or cross-sectional area, of the second platform.

The first platform—the smaller area—is intended to support the back of the user or sleeper, specifically by providing a rotational force to keep the user on their side.

The second platform—the larger area—is intended to support the body weight of the user, including head, arms, torso, legs, and feet.

The first platform and second platform are adjacent, with no intervening flat section. Both platforms include inner rails of a fixed height, and outer rails of adjustable height. Adjusting the height of the outer rails changes the angle of each platform with respect to horizontal, allowing the sleeper to adjust the location and amount of pressure against their body.

The first platform, for back support, can travel through a range of angles from zero degrees—flat or horizontal—to seventy-five degrees—nearly vertical.

The first platform prevents the user from rolling onto their back. Given that its ideal position for use is nearly vertical, this section does not bear much of the user's weight. Rather, this section provides a near-horizontal force against the back of the user, preventing the user from rolling onto their back.

The second platform, for support of the body, can travel through a range of angles zero degrees—flat or horizontal—to fifteen degrees—enough to push the sleeper against the first platform, but not enough to prevent them from being able to climb out of bed. The device can be set to prevent any angle in excess of fifteen degrees.

The near-horizontal position of the second platform redirects the weight of the user's face, hips, shoulders, and knees. Rather than this weight pressing down into the user's body, it is supported by the mattress above the second platform. The result is a comfortable and consistent sleep position, in addition to a multiplicity of health benefits.

The first and second sections are each the full length of the bed. Specifically, the longer, top to bottom dimension, and not the left-to-right width, or shorter dimension.

The first platform and second platform are adjacent to each other. Each is independently adjustable.

Hinges are located between the two platforms. Thus, there is no intervening flat surface, only the two adjustable, adjoining platforms, immediately side-by-side. Stated differently, every platform that forms the portions of the bedframe that support a mattress is adjustable.

The first platform and second platforms are ideally powered by linear actuators, for example, electric linear actuators. A linear actuator moves in/out or extends/retracts to move a member to which it is attached. Other forms of power are possible, including manual actuation.

An outer rail fully surrounds the platforms when the platforms are in a lowered, or flat position.

This fixed outer rail creates a strong bed frame, and also provides a static shape for placement inside standard bedframe surrounds. The result is an aesthetically pleasing and functional bed frame.

The bed frame can be manufactured in any size to match common mattress sizes. For example, twin, full, queen, and king. Full size is the most appropriate size because the disclosed bed frame is likely used by a single sleeper, and most users will be comfortable in a bed with a full size mattress. Larger sizes will work, but are likely unnecessarily large.

The angles of the platforms are preferably controlled using a wireless remote that the user can carry into bed.

The ideal controller includes six buttons, allowing the user to control each section up/down individually and both sections up/down simultaneously.

In one embodiment, buttons wirelessly connect to controller/processor, that actuates relay to activate an electric linear actuator associated with each section.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
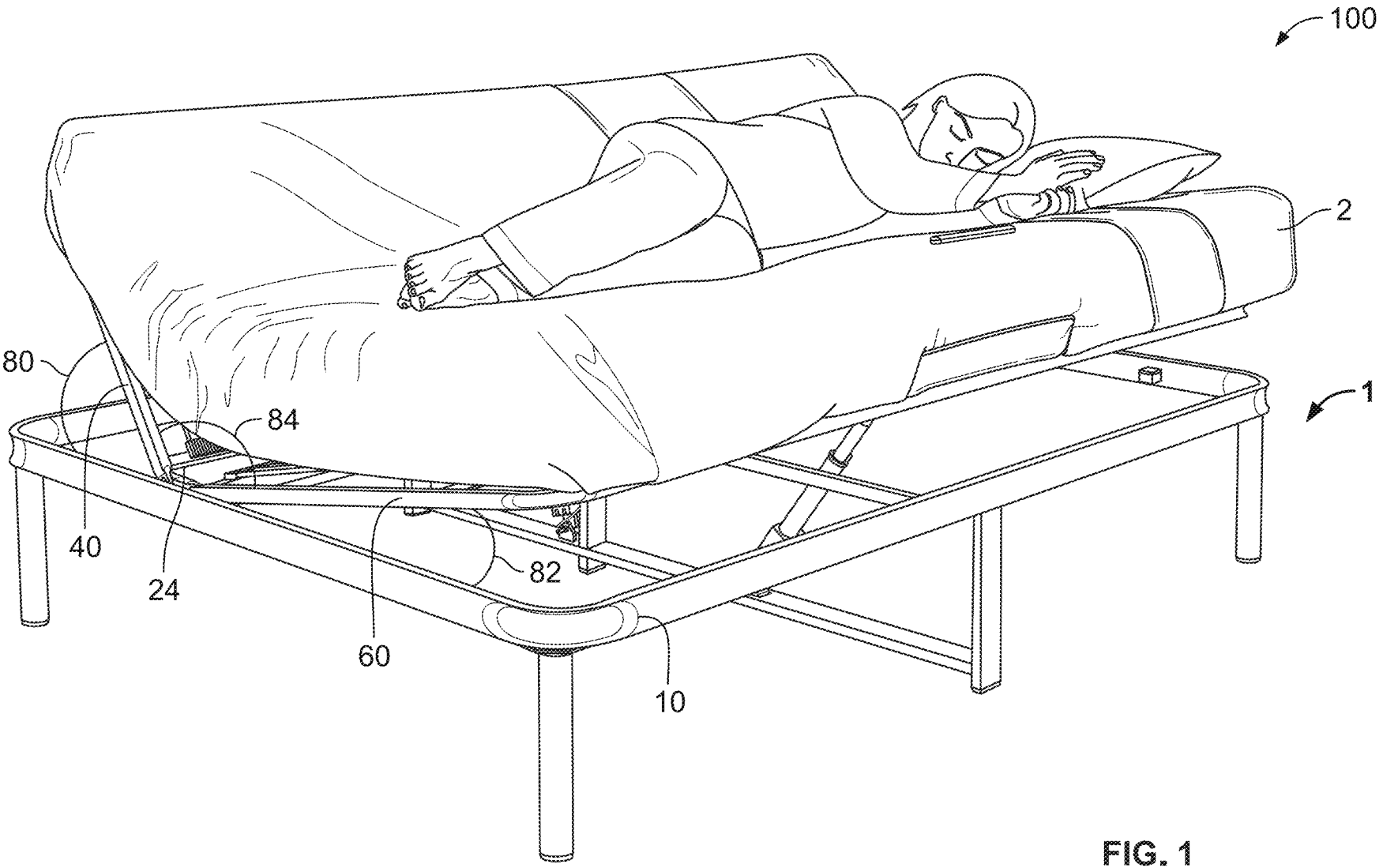
FIG. 1 illustrates a first isometric view of the bed frame for side sleeping in a partially-folded position, in use.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first isometric view of the bed frame for side sleeping in a partially-folded position, in use is shown.

The bed frame for side sleeping 1 is shown, including a mattress 2.

The bed frame for side sleeping 1 is primary formed from a first platform 40 and a second platform 60. The first platform 40 creates a first platform angle 80 with respect to the horizontal outer rail 10, and the second platform 60 forms a second platform angle 82 with respect to the horizontal outer rail 10.

A between-platform angle 84 is created between the first platform 40 and the second platform 60.

There is a mattress gap 24 shown between the bed frame for side sleeping 1 and the mattress 2. If the mattress 2 is too stiff to follow the shape of the first platform 40 and the second platform 60, it may pull away from the bed frame for side sleeping 1, creating a mattress gap 24. The invention still functions, and the weight of the user will reduce the size of the mattress gap 24.

Figure 2:
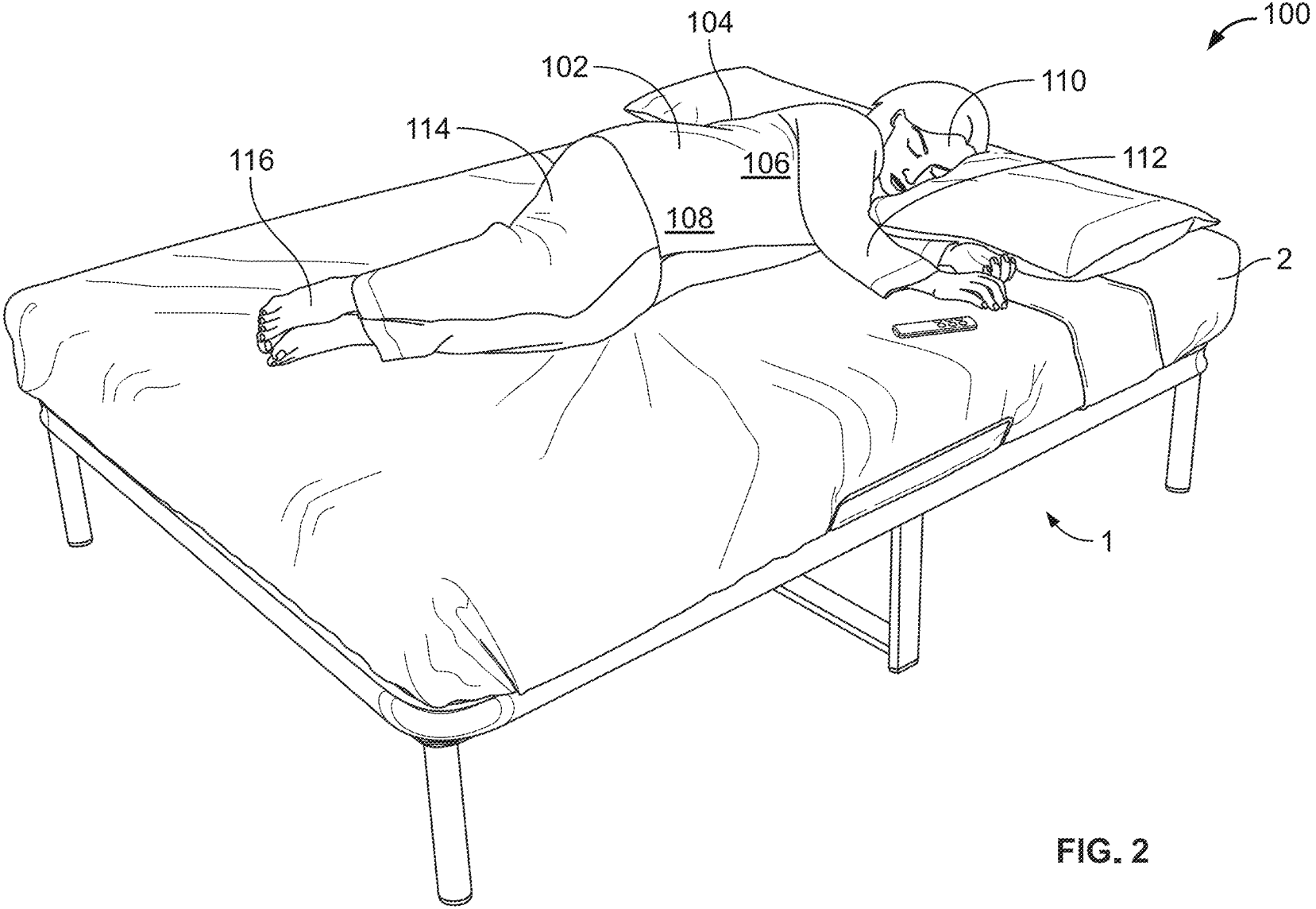
FIG. 2 illustrates a second isometric view of the bed frame for side sleeping in an unfolded position, in use.

Referring to FIG. 2, a second isometric view of the bed frame for side sleeping in an unfolded position, in use is shown.

Again shown are the bed frame for side sleeping 1 and the mattress 2.

The user 100, or sleeper, is shown, including their torso 102, back 104, chest 106, stomach 108, head 110, arms 112, legs 114, and feet 116.

Figure 3:
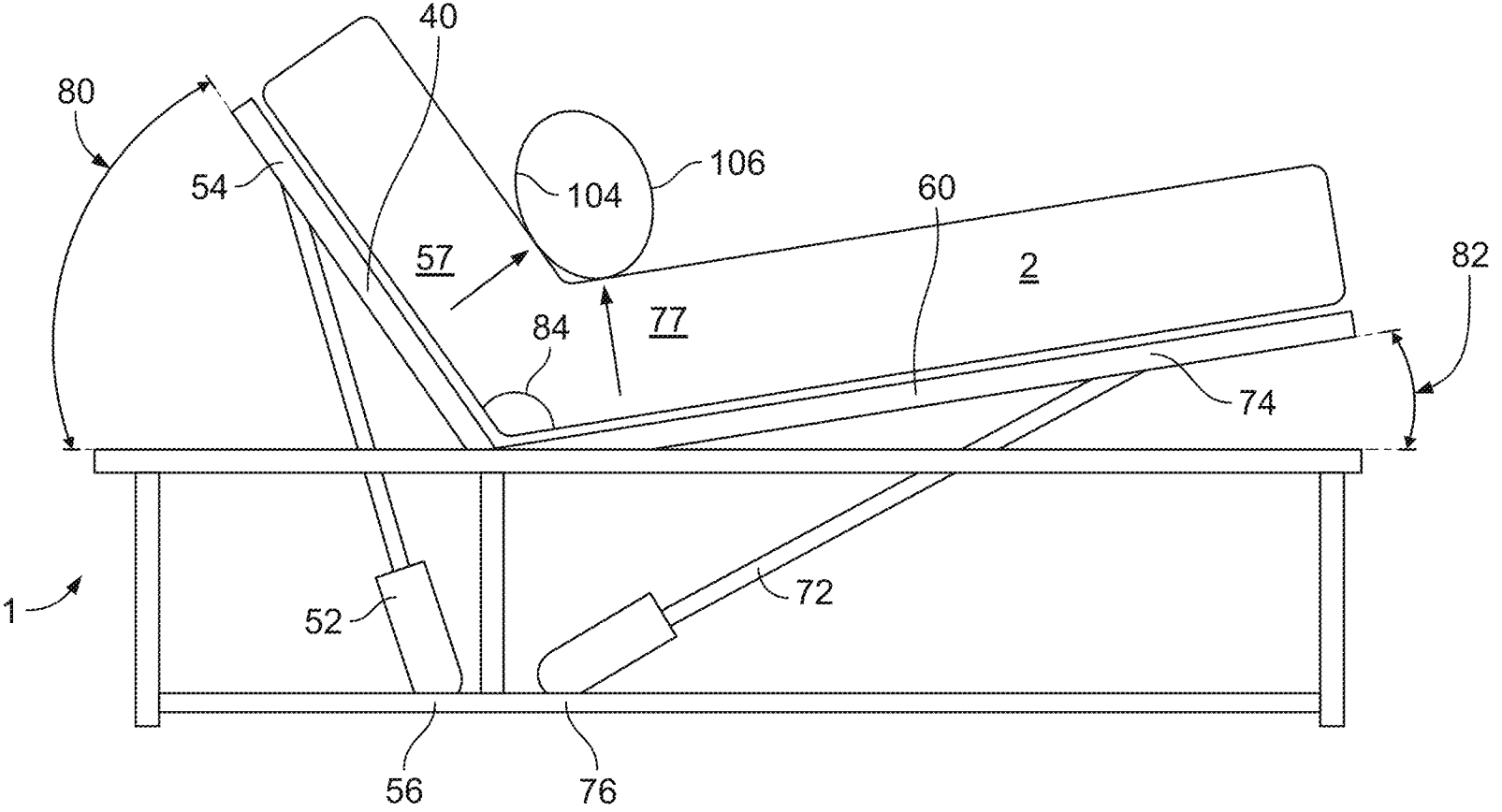
FIG. 3 illustrates a schematic view of the bed frame for side sleeping.

Referring to FIG. 3, a schematic view of the bed frame for side sleeping is shown.

The bed frame for side sleeping 1 is primary formed from the first platform 40 and second platform 60, topped with a mattress 2.

The first platform 40 includes a first platform linear actuator 52 with a first platform linear actuator upper pivot 54 and a first platform linear actuator lower pivot 56. The first platform angle 80 acts to create a first platform force 57 against the user 100, thus creating a torque, rotating the user 100 away from their back 104 and toward their chest 106.

The second platform 60 includes a second platform linear actuator 72 with a second platform linear actuator upper pivot 74 a second platform linear actuator lower pivot 76. The second platform force 77 is substantially an upward force, holding the weight of the user 100, with a small torque created to prevent the user 100 from rolling onto their chest 106.

Figure 4:
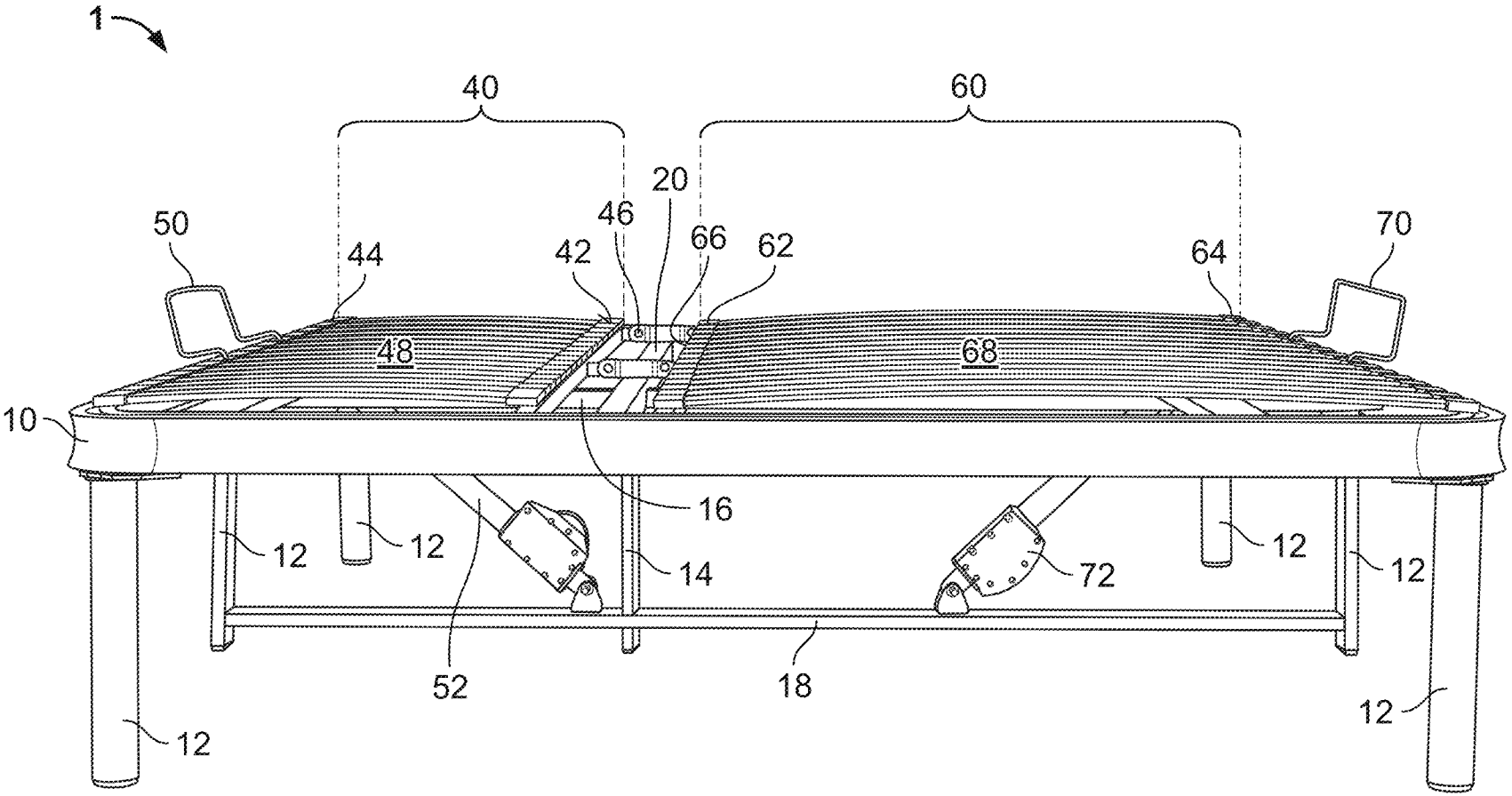
FIG. 4 illustrates a first end-on view of the bed frame for side sleeping in an unfolded position.
Figure 5:
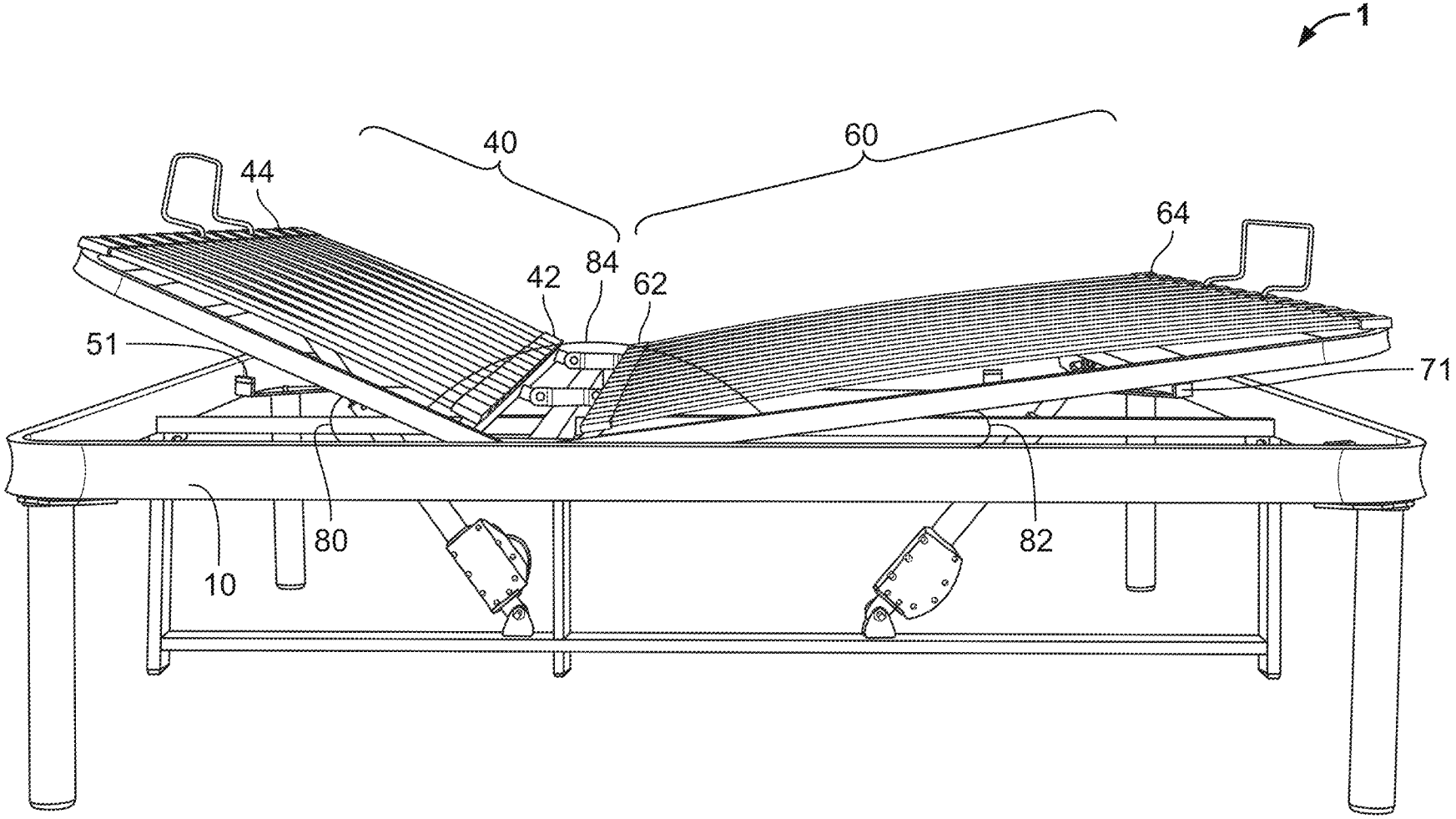
FIG. 5 illustrates a second end-on view of the bed frame for side sleeping in a partially-folded position.
Figure 6:
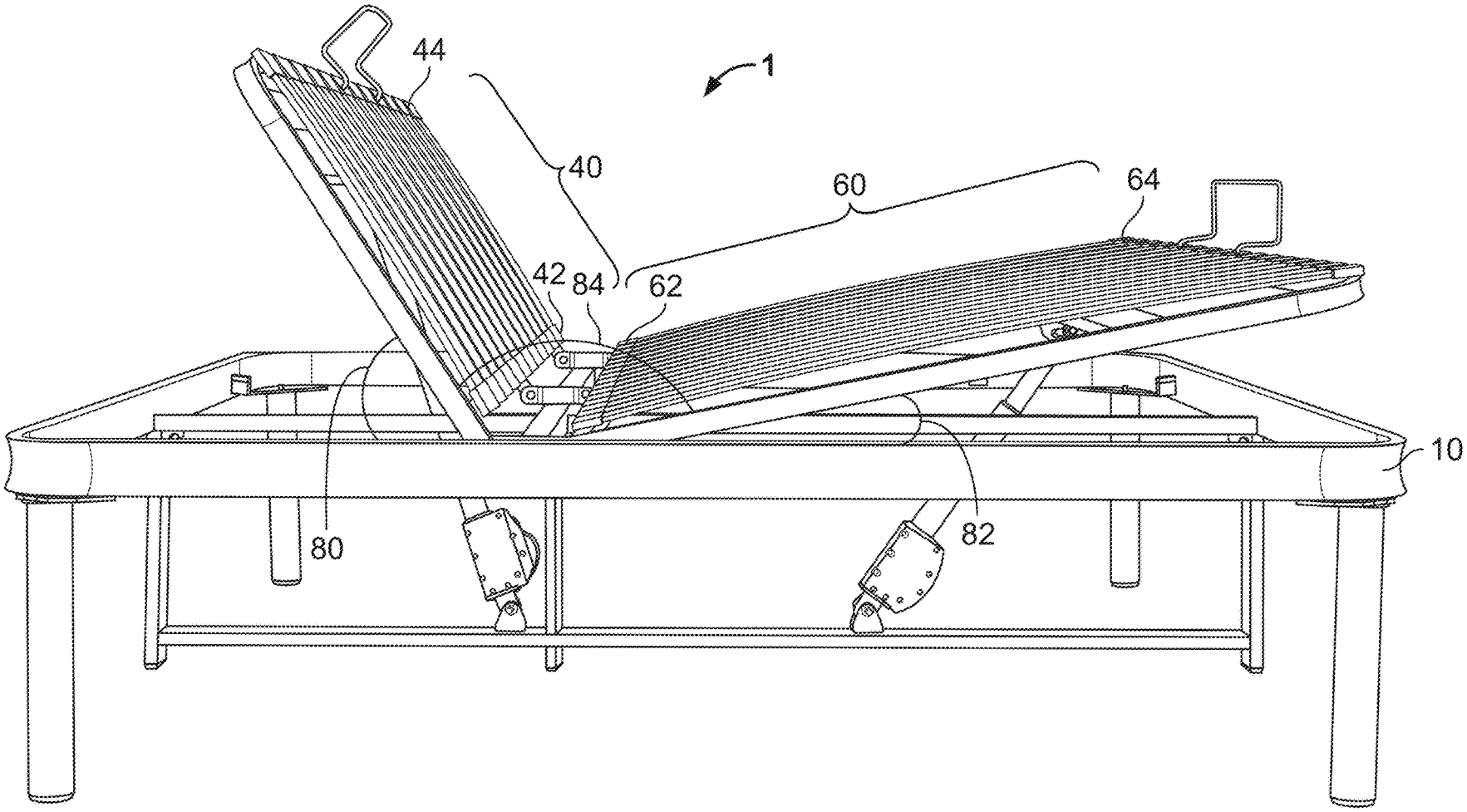
FIG. 6 illustrates a third end-on view of the bed frame for side sleeping in a fully-folded position.

Referring to FIGS. 4, 5, and 6, first, second, and third end-on views of the bed frame for side sleeping are shown in flat, partially-folded, and fully-folded positions.

The bed frame for side sleeping 1 includes a first platform 40 with first platform inner rail 42 and first platform outer rail 44.

The first platform hinge 46 connects the first platform inner rail 42 of the first platform 40 to the fixed hinge-support member 20.

The first platform slats 48 run between the first platform inner rail and the first platform outer rail to create a surface for the mattress 2 (see FIG. 1).

A first platform mattress clip 50 interacts with the mattress 2 to hold it in place during folding/unfolding operations.

The first platform linear actuator 52 affects the first platform angle 80 of the first platform 40.

When fully lowered, the first platform 40 rests against the first platform stop 51.

The bed frame for side sleeping 1 includes a second platform 60 with second platform inner rail 62 and second platform outer rail 64.

The second platform hinge 66 connects the second platform inner rail 62 of the second platform 60 to the fixed hinge-support member 20.

The second platform slats 68 run between the second platform inner rail 62 and the second platform outer rail 64 to create a surface for the mattress 2 (see FIG. 1).

A second platform mattress clip 70 interacts with the mattress 2 to hold it in place during folding/unfolding operations.

The second platform linear actuator 72 affects the second platform angle 82 of the second platform 60.

When fully lowered, the second platform 60 rests against the second platform stop 71.

Altering the first platform angle 80 or second platform angle 82 affects the between-platform angle 84. The sum of the first platform angle 80, second platform angle 82, and between-platform angle 84 is one hundred and eighty degrees.

In the fully-raised position shown in FIG. 6, the height of the first platform outer rail 44 is higher than that of the second platform outer rail 64, despite the first platform width 58 being less than the second platform width 78.

Also shown are outer rail 10, outer legs 12, and center leg 14.

Figure 7:
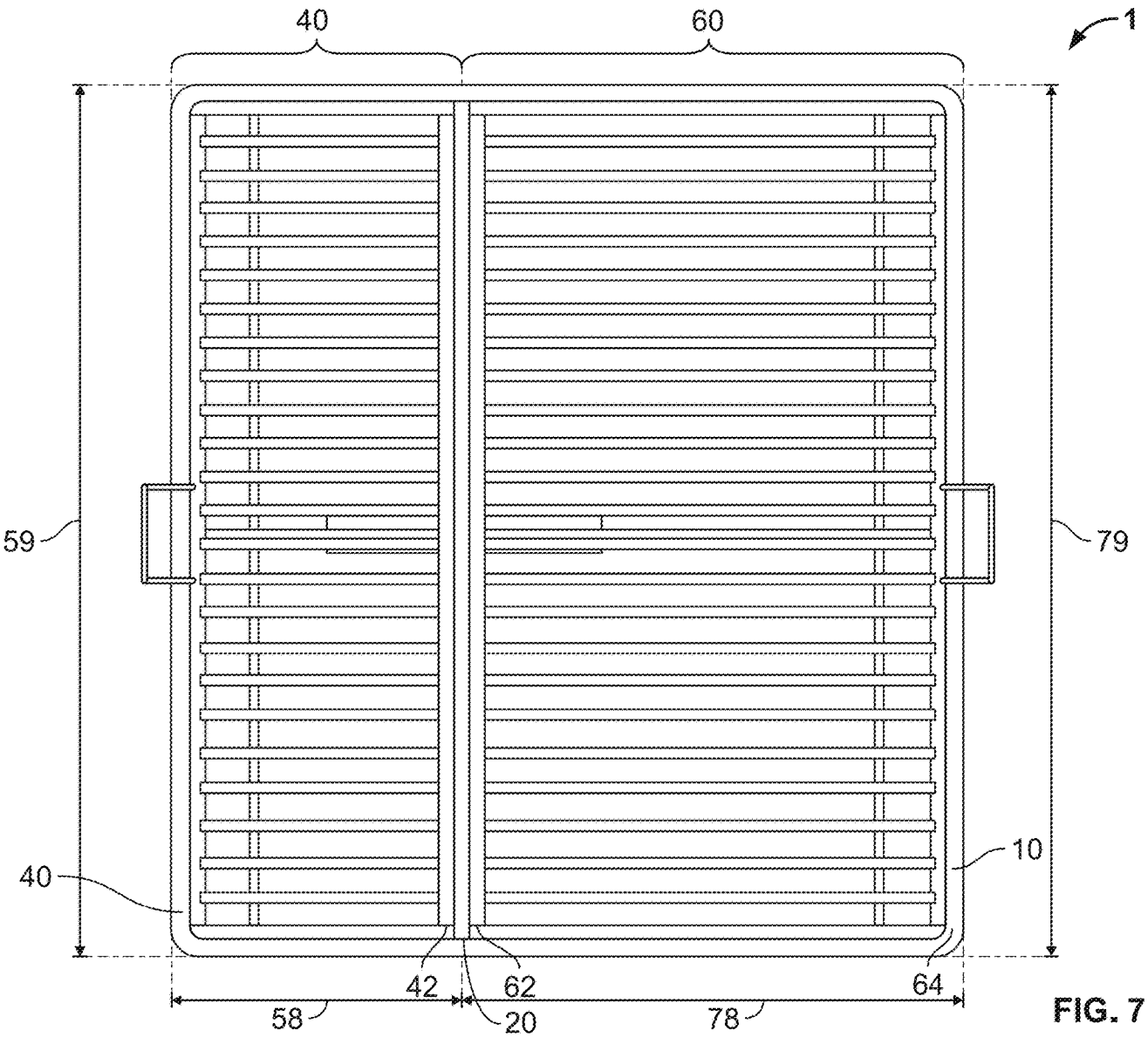
FIG. 7 illustrates a top view of the bed frame for side sleeping in an unfolded position.

Referring to FIG. 7, a top view of the bed frame for side sleeping in an unfolded position is shown.

The bed frame for side sleeping 1 includes a first platform 40 with first platform inner rail 42 and first platform outer rail 44, and second platform 60 with second platform inner rail 62 and second platform outer rail 64. The first platform 40 includes dimensions of a first platform width 58 and a first platform length 59.

The second platform 60 includes dimensions of a second platform width 78 and a second platform length 79.

In the preferred embodiment, the first platform length 59 and the second platform length 79 are the same, and the first platform width 58 is fifty percent, or less, of the second platform width 78.

Figure 8:
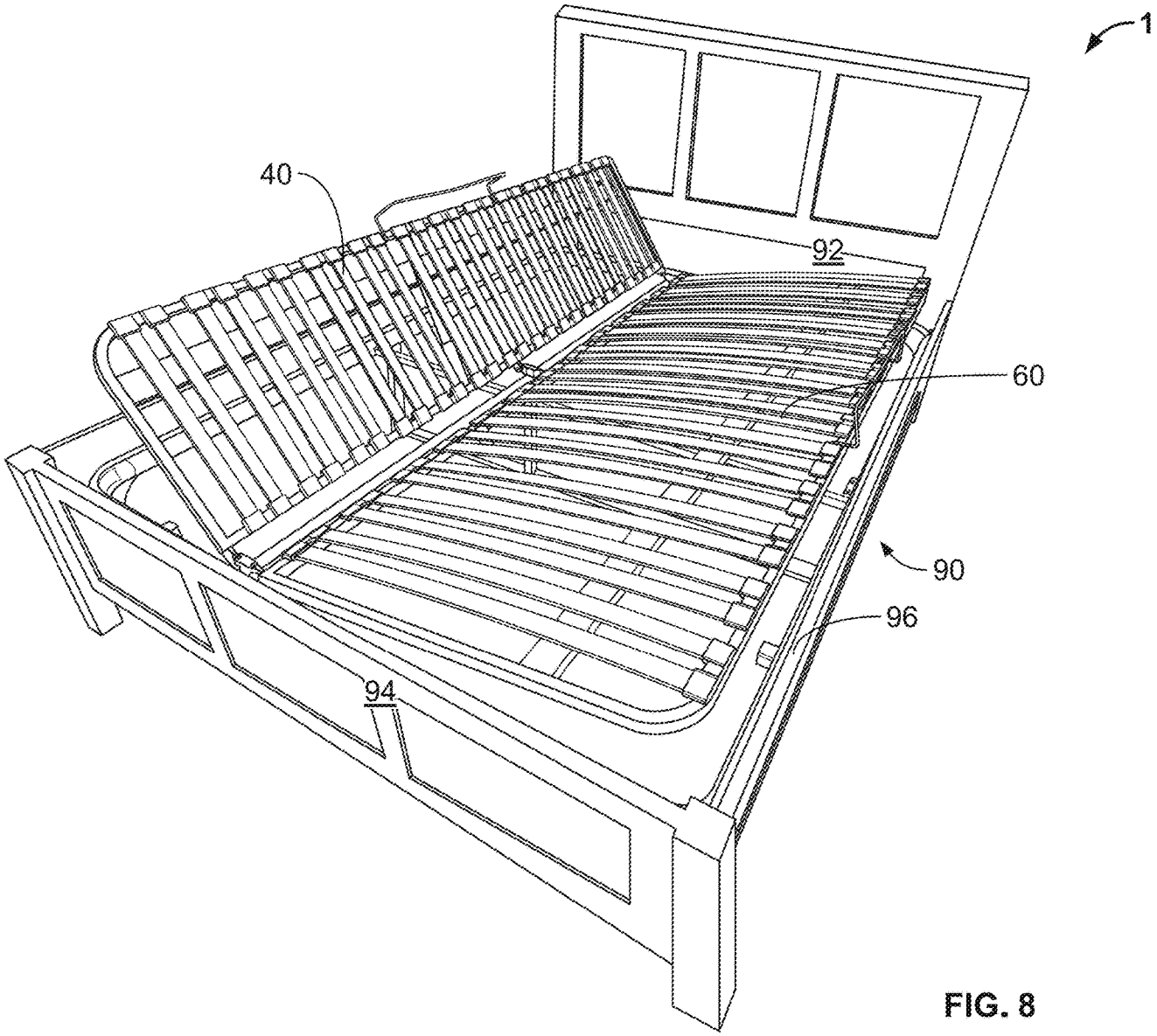
FIG. 8 illustrates a third isometric view of the bed frame for side sleeping in a bed-frame surround.

Referring to FIG. 8, a third isometric view of the bed frame for side sleeping in a bed-frame surround is shown.

The bed frame for side sleeping 1 is shown within a bed surround 90 formed from a headboard 92, footboard 94, and two sides 96. When a mattress 2 (see FIG. 1) is added to the top of the bed frame 1, the system appears like a conventional bed.

Figure 9:
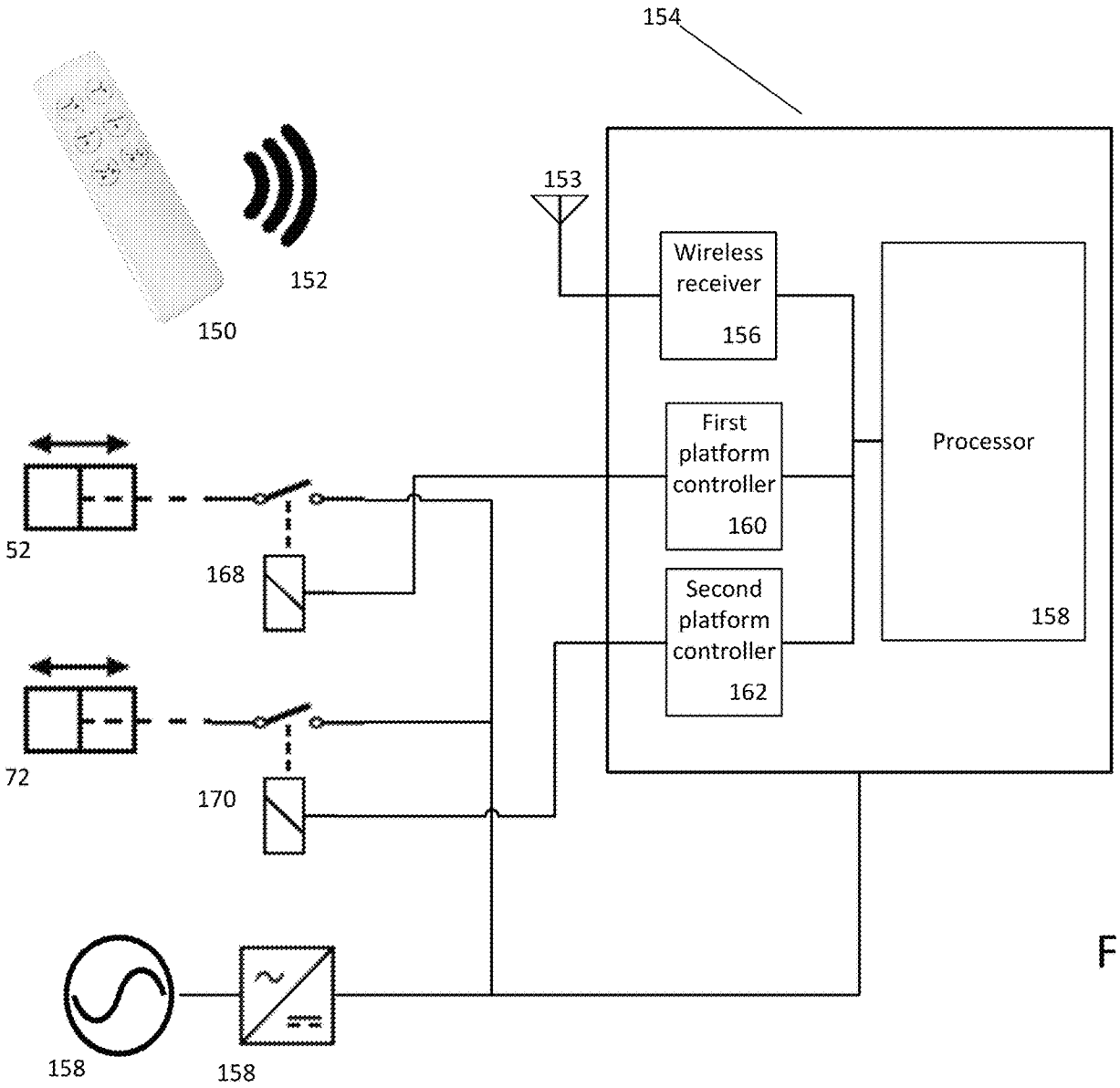
FIG. 9 illustrates a schematic of the bed frame remote and controller.

Referring to FIG. 9, a schematic view of the bed frame remote and controller is shown.

The remote 150 sends a wireless signal 152 to the antenna 153 and wireless receiver 156 of the frame controller 154. The processor 158 interprets the signal, activating one or both of the first platform controller 160 and second platform controller 162.

The first platform controller 160 and/or second platform controller 162 activate their respective first platform relay 168 or second platform relay 170, carrying power from the AC power source 164 through the AC/DC rectifier 166, causing the first platform linear actuator 52 or second platform linear actuator 72 to actuate.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A bed frame for use by a user sleeping on their side, the bed frame for use on a floor, the bed frame comprising:

an outer rail;

a first platform with a first platform inner rail and a first platform outer rail;

the first platform pivoting about a first platform hinge, the first platform hinge affixed to the first platform inner rail;

the first platform configured to create a first platform angle with respect to the outer rail;

the first platform having a first platform cross-sectional area;

a second platform with a second platform inner rail and second platform outer rail;

the second platform pivoting about a second platform hinge, the second platform hinge affixed to the second platform inner rail;

the second platform configured to create a second platform angle with respect to the outer rail;

the second platform having a second platform cross-sectional area;

a fixed hinge-support member;

the fixed hinge-support member spanning across the outer rail;

the first platform hinge affixed to the fixed hinge-support member;

the second platform hinge affixed to the fixed hinge-support member;

wherein the fixed hinge-support member remains stationary with respect to the floor, in both a parallel direction and a perpendicular direction, regardless of changes to the first platform angle and the second platform angle;

the first platform cross-sectional area 50% or less of the second platform cross-sectional area;

the first platform hinge directly adjacent to the second platform hinge;

the first platform and the second platform creating a between-platform angle with respect to each other; and whereby the first platform supports a back of user, and the second platform supports a side of user.

2. The bed frame for use by a user sleeping on their side of claim 1, wherein:

the first platform angle is limited to between 0 and 75 degrees;

whereby the user can adjust the first platform angle to create a force against the back, thus maintaining a side-sleeping position.

3. The bed frame for use by a user sleeping on their side of claim 1, wherein:

the second platform angle is limited to between 0 and 15 degrees;

whereby the second platform angle cannot exceed 15 degrees, thus the user is not trapped by the bed frame.

4. The bed frame for use by a user sleeping on their side of claim 2, wherein:

the second platform angle is limited to between 0 and 15 degrees;

whereby the second platform angle cannot exceed 15 degrees, thus the user is not trapped by the bed frame.

5. The bed frame for use by a user sleeping on their side of claim 1, further comprising:

a first linear actuator that controls only the first platform angle;

a second linear actuator that controls only the second platform angle;

the first linear actuator configured to extend, thereby increasing only the first platform angle;

the second linear actuator configured to extend, thereby increasing only the second platform angle;

whereby the user can control the first linear actuator and the second linear actuator to adjust the first platform angle of the first platform and the second platform angle of the second platform as desired for comfort.

6. A bed frame for use by a side sleeper, the bed frame placed on a floor, the bed frame comprising:

an outer rail;

a first platform with first platform inner rail, first platform outer rail, and first platform hinge;

the first platform having a first platform width;

the first platform hinge affixed to the first platform inner rail;

the first platform having a first platform angle;

a second platform with second platform inner rail, second platform outer rail, and second platform hinge;

the second platform having a second platform width;

the second platform hinge affixed to the second platform inner rail;

the second platform having a second platform angle;

a fixed hinge-support member;

the fixed hinge-support member spanning across the outer rail;

the first platform hinge affixed to the fixed hinge-support member;

the second platform hinge affixed to the fixed hinge-support member;

wherein the fixed hinge-support member remains stationary with respect to the floor, in both a parallel direction and a perpendicular direction, regardless of changes to the first platform angle and the second platform angle;

the first platform hinge affixed adjacent to the second platform hinge;

the first platform width being one-half or less of the second platform width;

the first platform outer rail and second platform outer rail able to independently increase in elevation with respect to the outer rail, thus angling the first platform toward the second platform; and whereby the side sleeper can adjust the first platform to support their back, and the second platform to support their body and legs, thus maintaining a side-sleeping position.

7. The bed frame for use by a side sleeper of claim 6, wherein:

the first platform angle is limited to between 0 and 75 degrees;

whereby the side sleeper can adjust the first platform angle to create a force against their back, thus maintaining a side-sleeping position.

8. The bed frame for use by a side sleeper of claim 6, wherein:

the second platform angle is limited to between 0 and 15 degrees;

whereby the second platform angle cannot exceed 15 degrees, thus the side sleeper cannot be trapped by the bed frame.

9. The bed frame for use by a side sleeper of claim 7, wherein:

the second platform angle is limited to between 0 and 15 degrees;

whereby the second platform angle cannot exceed 15 degrees, thus the side sleeper cannot be trapped by the bed frame.

10. The bed frame for use by a side sleeper of claim 6, further comprising:

a first linear actuator that controls only the first platform angle;

a second linear actuator that controls only the second platform angle;

the first linear actuator configured to extend, thereby increasing only the first platform angle;

the second linear actuator configured to extend, thereby increasing only the second platform angle;

whereby the side sleeper can control the first linear actuator and the second linear actuator to adjust the first platform angle of the first platform and the second platform angle of the second platform as desired for comfort.

11. A bed frame, for use on a horizontal floor, for a user who sleeps on their side, the bed frame comprising:

a first platform including:

a first platform surface area formed from a first platform width and a first platform length;

a first platform inner rail;

the first platform inner rail affixed to a first hinge;

the first platform inner rail having a first fixed height;

a first platform outer rail;

the first platform outer rail having a first adjustable height;

a first platform angle measured between the first platform surface area and the horizontal floor;

a second platform including:

a second platform surface area formed from a second platform width and a second platform length;

a second platform inner rail;

the second platform inner rail affixed to a second hinge;

the second platform inner rail having a second fixed height;

a second platform outer rail;

the second platform outer rail having a second adjustable height;

a second platform angle measured between the second platform surface area and the horizontal floor;

a fixed hinge-support member;

the fixed hinge-support member spanning across the outer rail;

the first platform hinge affixed to the fixed hinge-support member;

the second platform hinge affixed to the fixed hinge-support member;

wherein the fixed hinge-support member remains stationary with respect to the floor, in both a parallel direction and a perpendicular direction, regardless of changes to the first platform angle and the second platform angle;

the first hinge adjacent to the second hinge;

the first platform surface area is 50% or less in size compared to the second platform surface area; and whereby the user can adjust the first adjustable height to support their back, and the second adjustable height to support their body and legs, thus maintaining a side-sleeping position.

12. The bed frame for a user who sleeps on their side of claim 11, wherein:

the first adjustable height includes a first maximum height;

the second adjustable height includes a second maximum height;

the first maximum height is greater than the second maximum height.

13. The bed frame for a user who sleeps on their side of claim 11, wherein:

the first platform angle is limited to between 0 and 75 degrees;

whereby the user can adjust the first platform angle to create a force against their back, thus maintaining a side-sleeping position.

14. The bed frame for a user who sleeps on their side of claim 11, wherein:

the second platform angle is limited to between 0 and 15 degrees;

whereby the second platform angle cannot exceed 15 degrees, thus ensuring the user cannot be trapped by the bed frame.

15. The bed frame for a user who sleeps on their side of claim 13, wherein:

the second platform angle is limited to between 0 and 15 degrees;

whereby the second platform angle cannot exceed 15 degrees, thus ensuring the user cannot be trapped by the bed frame.

16. The bed frame for a user who sleeps on their side of claim 11, further comprising:

a first linear actuator that controls only the first platform angle;

a second linear actuator that controls only the second platform angle;

the first linear actuator configured to extend, thereby increasing only the first platform angle;

the second linear actuator configured to extend, thereby increasing only the second platform angle;

whereby the user can control the first linear actuator and the second linear actuator to adjust the first platform angle of the first platform and the second platform angle of the second platform as desired for comfort.

* * * * *